US011180972B2

(12) United States Patent
Keeling

(10) Patent No.: US 11,180,972 B2
(45) Date of Patent: Nov. 23, 2021

(54) DOWNHOLE TOOL SYSTEM AND METHODS RELATED THERETO

(71) Applicant: Stanley Keeling, Fort Worth, TX (US)

(72) Inventor: Stanley Keeling, Fort Worth, TX (US)

( * ) Notice: Subject to any disclaimer, the term of this patent is extended or adjusted under 35 U.S.C. 154(b) by 64 days.

(21) Appl. No.: 16/782,489

(22) Filed: Feb. 5, 2020

(65) Prior Publication Data

US 2021/0238950 A1 Aug. 5, 2021

(51) Int. Cl.
*E21B 33/128* (2006.01)
*E21B 33/12* (2006.01)
*E21B 33/129* (2006.01)

(52) U.S. Cl.
CPC ..... *E21B 33/128* (2013.01); *E21B 33/1208* (2013.01); *E21B 33/1293* (2013.01); *E21B 2200/01* (2020.05)

(58) Field of Classification Search
CPC .. E21B 33/128; E21B 33/129; E21B 33/1208; E21B 33/1293; E21B 2200/01
See application file for complete search history.

(56) References Cited

U.S. PATENT DOCUMENTS 8,590,616 B1 * 11/2013 McClinton ..... E21B 33/1294 166/135
2002/0096365 A1 * 7/2002 Berscheidt ..... E21B 33/1294 175/57
2008/0060821 A1 * 3/2008 Smith ..... E21B 33/1216 166/387

* cited by examiner

*Primary Examiner* — David Carroll

(57) ABSTRACT

The disclosed is a method of isolating zones in a wellbore and tools thereof, specifically implementing a slip carrier with tongue and groove design purposed to secure an anchor, including parts with different durometers additionally with a nose cone on a bridge plug/frac plug to be able to displace sand between plugs, and a mandrel with a J-latch system.

12 Claims, 23 Drawing Sheets

DOWNHOLE TOOL SYSTEM AND METHODS RELATED THERETO

FIELD OF THE INVENTION

The present invention relates to tools used in the oil and gas industries. More specifically, this disclosure relates to downhole tools that may be inserted in a wellbore using a variety of methods such as wireline, coil tubing or the kind and may be used for isolating zones in the wellbore. This tool may be designed for use as a frac plug or a bridge plug having more than one moveable part and made of a variety of machinable materials such as composites, industrial plastics, Teflon or epoxy materials, various metals or minerals.

BACKGROUND OF THE INVENTION

Oilfield drilling and production methods and technologies are rapidly changing due to the high demand of hydrocarbons throughout the world. Reservoirs that contain hydrocarbons are usually found in layers in the earth's crust that run parallel to the surface. Multiple wells must be drilled if they are done vertically in order to extract these hydrocarbons. With the advancement of horizontal drilling technologies, we are now able to access the reservoir in the earth's layers at more intervals in the same formation by drilling a single well horizontally and extracting the hydrocarbons at different intervals or stages. When using this method, the operation is much more efficient at extracting the most hydrocarbons because they extract them in zones. As in most industries, the main constraint in horizontal drilling is cost; the industry is always looking at new ways to improve technology and bring production costs down.

Use of tools in down-hole conditions comes with specific concerns not occurring in other situations. Some of them are the fact they often use higher frac and pump pressures along with tighter casing tolerances due to higher pressure rated casing. This could result in the tools getting uncontrollably stuck if parts of the tool become loosened or dislodged as they are being deployed. It is desirable in these conditions to have a tool which has parts of the tool that are complete parts and not segmented or independently loose from each other. Like horizontal drilling, fracing is a process which grows in popularity to produce hydrocarbons. Typically, in this process an isolation tool is used to isolate areas of the wellbore referred to as zones. This isolation tool is desired to be constructed of durable material and includes at least one seal element constructed of a compressible material associated therewith, where the seal is expanded radically outward to engage the inside diameter of the casing to seal off a speciation of the wellbore. After the tool is set frac fluid is pumped or injected into the wellbore at high pressures into the targeted zone. The results being the valuable hydrocarbons are more readily and easily produced through the fractures in the formation from treating the well in multiple zones.

When the zones have been fracked, the frac plugs or bridge plugs must be drilled up. This is done with coil tubing or conventional stick pipe with a drill bit on the bottom. In the treated zones between plugs there is sometimes an accumulation of sand and as the drill bit rotates on the nose cone, it can also rotate in the sand, taking more time to drill it up. It is desirable in this field to have a frac plug which is designed so that the nose cone has the capability of digging into the sand and becoming stationary enough to be drilled out easily, or have the capability of moving through the sand by displacing it so the nose cone can easily move through the sand to make contact with the frac plug below it.

More problematic is that the use of plugs in a wellbore is not without other concerns, as these tools are subject to other failure modes regardless of wellbore orientation. For example, when the plug is set into the wellbore, the gripping member could loosen, causing a pre-set before the plug reaches its destination, resulting in casing damage as well as operational delays such as setting another plug.

This situation could happen as a result of the slips being designed in a manner so as the slips are in separate segments and not connected in a solid cylindrical form. When a segment gets loose it is possible for it to extend out from the plug body and wedge between the plug body and the inside diameter of the casing. When this happens, the plug is unable to move farther and usually results in the plug pre-setting before it reaches desired depth. Another possible scenario that could cause the frac plug to pre-set is the possibility of an insert from the slips being dislodged and getting lodged between the inside diameter of the casing and the frac plug. It is also desirable for the nose cone to be designed so that the nose cone makes contact with the frac plug below it creates a positive locking mechanism to secure the nose in place attached at the point to the next plug to be drilled, greatly reducing the drill-out time and overall cost effectiveness.

There is a need in the industry for a slip carrier that is manufactured out of a material which is both drillable and strong enough to hold a frac plug in place once set. This slip is desired to have a design that would secure the anchor in a way as to prevent it from coming loose and lodging between the casing ID and frac plug to decrease the possibility of pre-sets. This slip would be made of a material such as the following but not limited to, composite, epoxy resin, industrial plastic polymers, cloth materials. The same slip may have inserts (or anchors) that are placed into the slip in a designed way as to prevent the insert from being released from the slip carrier and getting caught between the plug creating a preset. This anchor can be made of but not limited to soft metals such as aluminum, steel, cast iron, epoxy, epoxy-based resins, and industrial plastics such as HDPE, ceramics, or ceramic compound materials.

Upon completing the stages of the well the frac plugs must then be drilled out and this process is usually done by using coiled tubing or conventional pipe drilling through the plugs. These processes are known in the art.

The unit used to drill out the plugs lowers the drill bit onto the frac plug and as the bit is turning and a determined amount of weight is set against the frac plug which drills the materials out.

Once the frac plug is drilled past the gripping anchor member or slips, what remains of the frac plug is the nose cone. Problems can occur when trying to drill the nose cone out because it is no longer secured in place and can rotate under the drill bit making it harder to cut the material. There is need in the industry for a nose cone on a plug to be able to displace sand between plugs.

In this application wellbore plugs are generally referred to as "frac plugs" but other names by which they are known are bridge plugs and packers. Plugs have different configurations, depending on the exact goal of the operators. For example, the plug used in this application employs a "ball-drop" construction, or "ball in place" which seals off the zones when the frac ball is pumped down and seats in the seating area. The "ball in place" design is accomplished by placing the ball in the seating area, placing the setting adapter onto the mandrel by securing the set screws. The ball is then encapsulated "in place" until the shear screws are sheared. The ball can be unseated when the pressure is reduced above the frac plug allowing the bottom hole pressure to become greater. At this point fluid can flow through the frac plug. The invention is not limited to any one of these configurations.

SUMMARY OF THE INVENTION

The present invention is a frac plug implementing a slip carrier designed in a manner to secure an anchor that can hold the frac plug in place which removes the possibility of individual segments to extend outward or inserts to come out which will reduce the amount of presets during operation.

DETAILED DESCRIPTION OF THE INVENTION

For a better understanding of the disclosure, and to show by way of example how the same may be carried into effect, reference is now made to the numbered elements with a detailed description.

The terminology used herein is for the purpose of describing particular embodiments only and is not intended to be limiting of the invention. As used herein, the term "and/or" includes any and all combinations of one or more of the associated listed items. As used herein, the singular forms "a", "an", and "the" are intended to include the plural forms as well as the singular forms, unless the context clearly indicates otherwise. It will be further understood that the terms "comprises" and "comprising", when used in this specification, specify the presence of stated features, steps, operations, elements, and components, but do not preclude the presence or addition of one or more other features, steps, operations, elements, components, or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that several techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present disclosure is to be considered as an exemplification of the invention and is not intended to limit the invention to the specific embodiments illustrated by the figures or description below.

Figure 1:
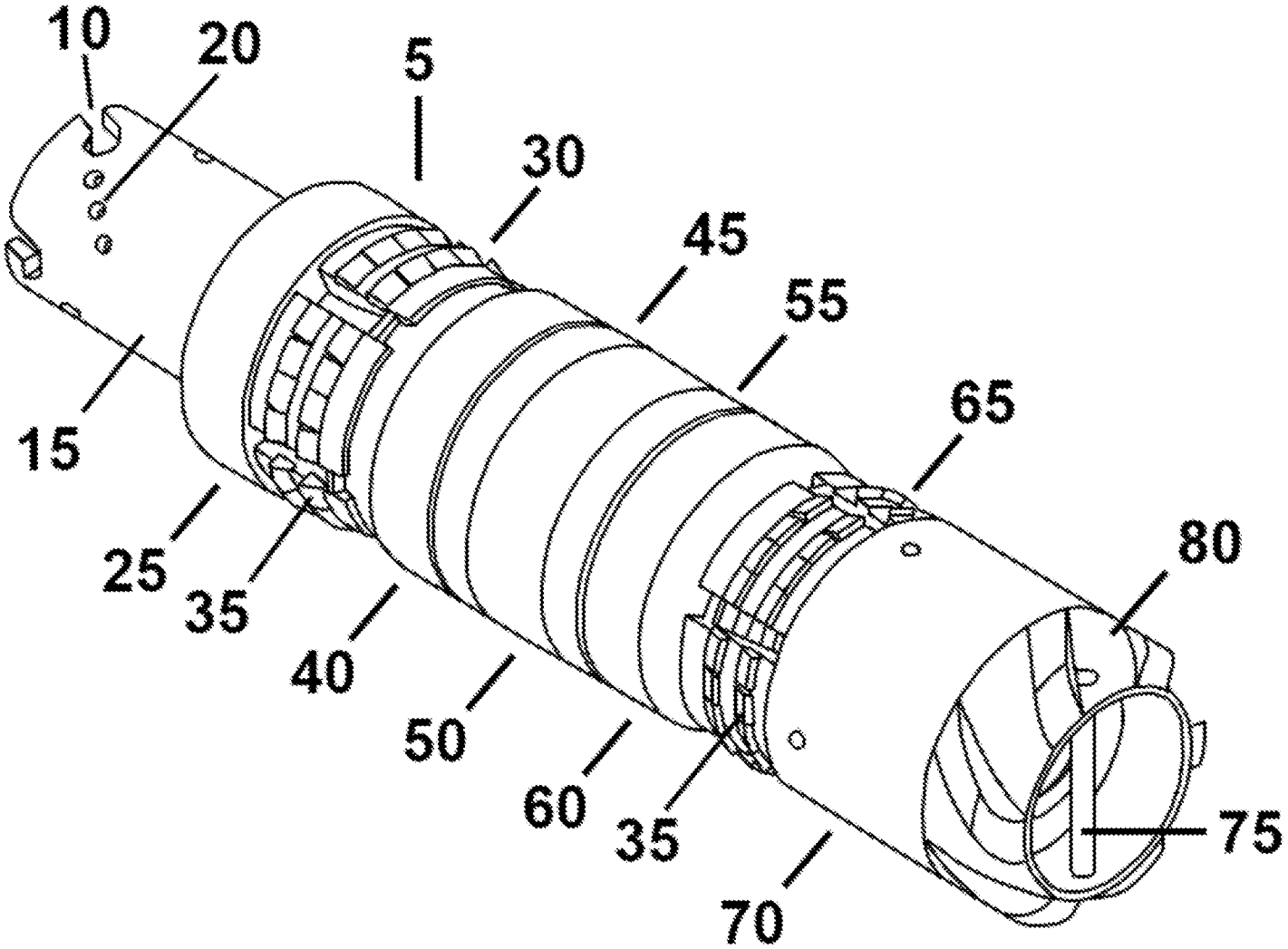
FIG. 1 is an orthogonal view of the plug.

FIG. 1 is an orthogonal view of one embodiment of the plug 5. In this embodiment, the nose cone 70 screws onto the downward end of the mandrel 15. The mandrel 15 works as a centerpiece all the way through the plug 5, where the nose cone 70 screws on the downward end of the mandrel 15, and the rest of the plug 5 pieces are placed one after the other onto the mandrel 15. Next to the nose cone 70 is the lower carrier 65 holding anchors 35, next is lower slip backup 60, then the lower small elastomer seal 55, then the large elastomer seal 50, then the small elastomer seal 45, then the upper slip backup 40, then a slip carrier 30 with anchors 35, then the load ring 25. The upward end of the mandrel 15 includes sheer screw holes 20 and a J-latch 10.

Figure 2:
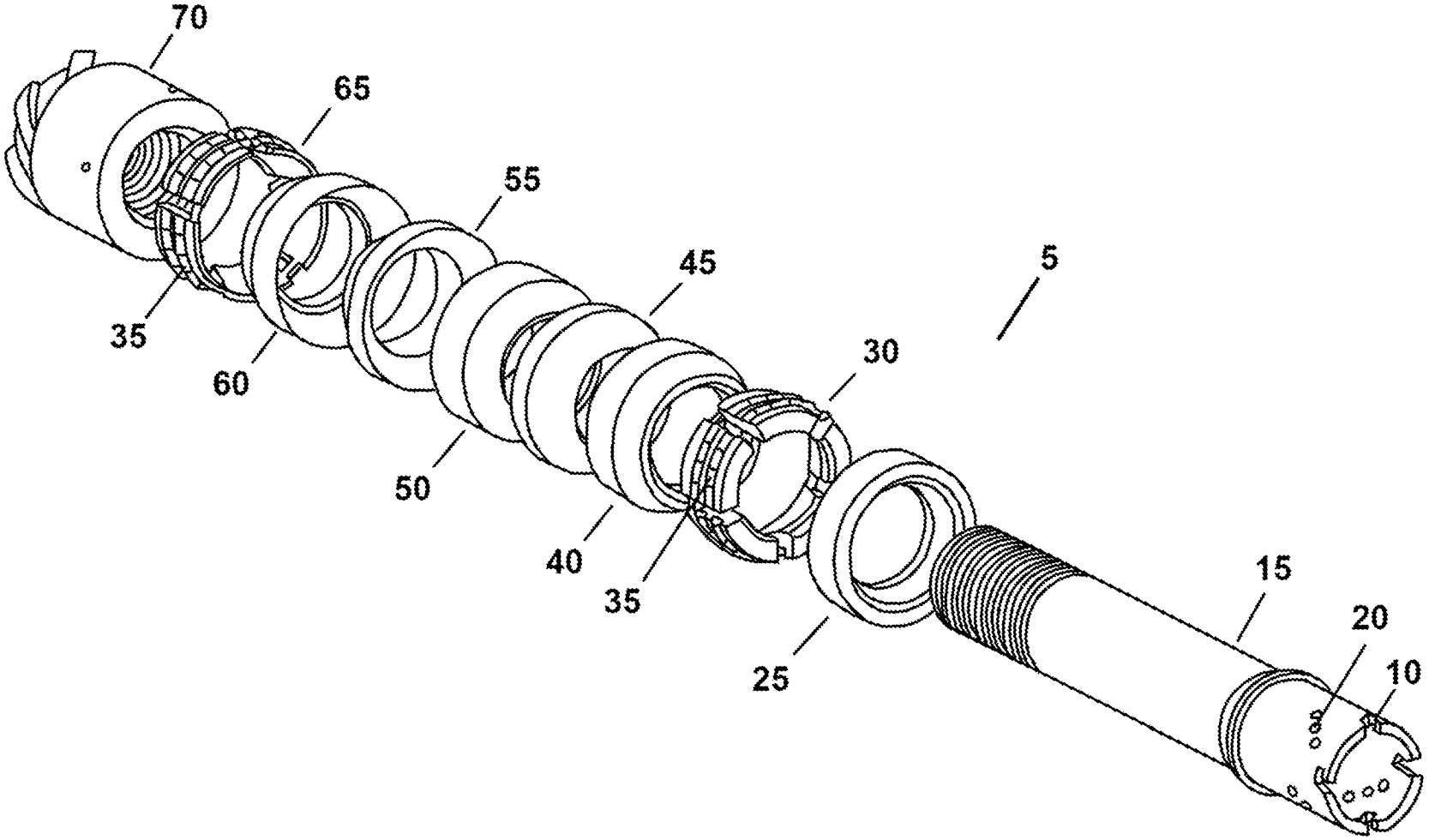
FIG. 2 is an exploded orthogonal view of the plug.

FIG. 2 is an exploded orthogonal view of the plug 5. The mandrel 15 acts as a centerpiece for the plug 5. The mandrel 15 features sheer screw holes 20 that will be used to disengage the plug 5 in the wellbore, it also has J-latches 10 on the same end used for coupling the plug 5 securely to the nose cone of plug 5 above it. A passageway or bore runs completely through the mandrel 15 and nose cone 70. As currently constructed, the mandrel 15 comprises male threads 17 onto which the various elements of the plug 5 are secured adjacent to each other. With matching female threads, the nose cone 70 is secured on the mandrel 15 last. Next to the nose cone 70 is the lower carrier 65 holding anchors 35, next is lower slip back up 60, then the lower small elastomer seal 55, then the large elastomer seal 50, then the small elastomer seal 45, then the upper slip backup 40, then a slip carrier 30 with anchors 35, then the load ring 25.

Figure 3:
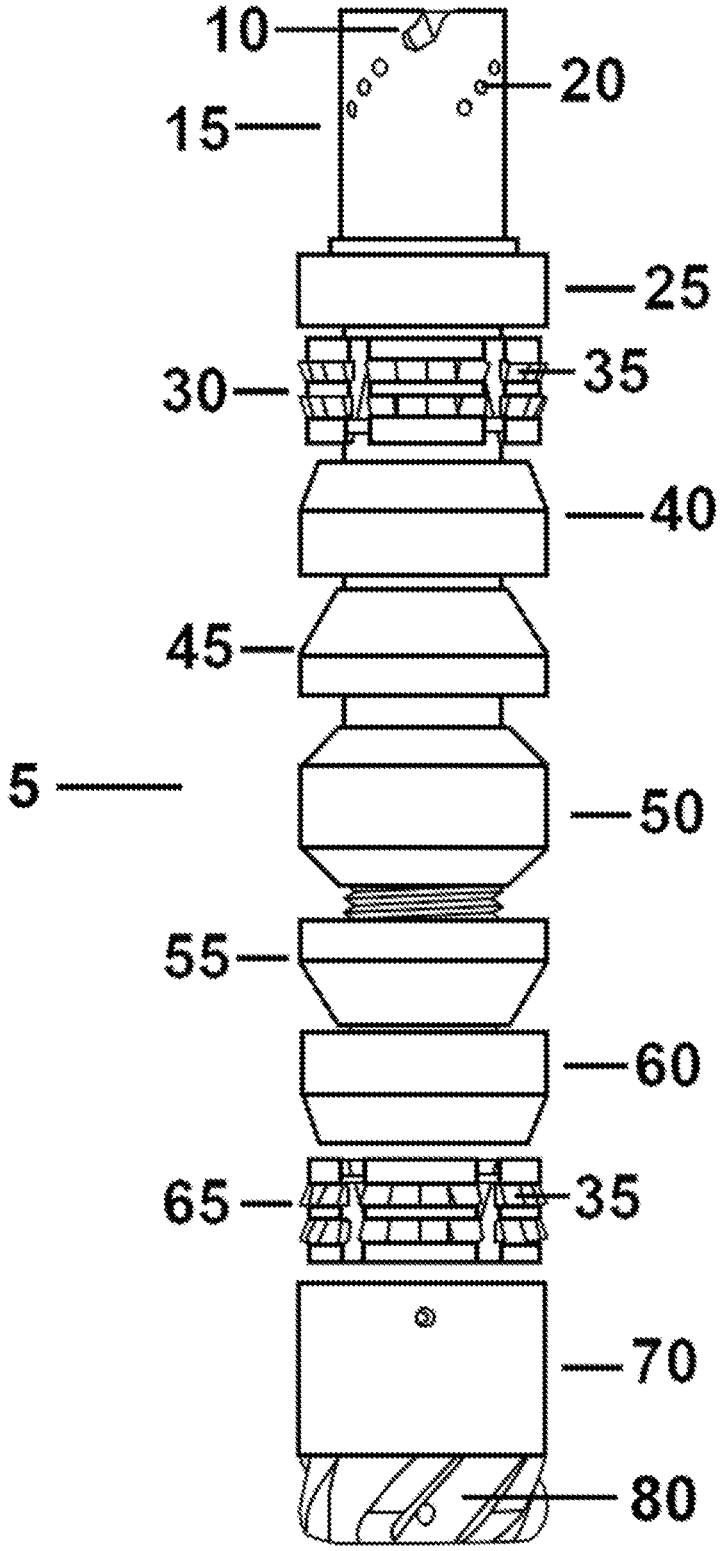
FIG. 3 is a partially exploded side view of the plug.

FIG. 3 shows a partial exploded side view of the plug 5 that shows some of the pieces secured onto the mandrel 15 and the order of which the pieces are placed on the plug 5. The load ring 25, is placed onto the mandrel 15, then the slip carrier 30, then the upper slip backup 40, the small elastomer seal 45, the large elastomer seal 50, the lower small elastomer seal 55, then the lower slip backup 60, then the lower carrier 65, and then the male threads of the mandrel 15 secure the plug 5 to the female threads of the nose cone 70.

Figure 4:
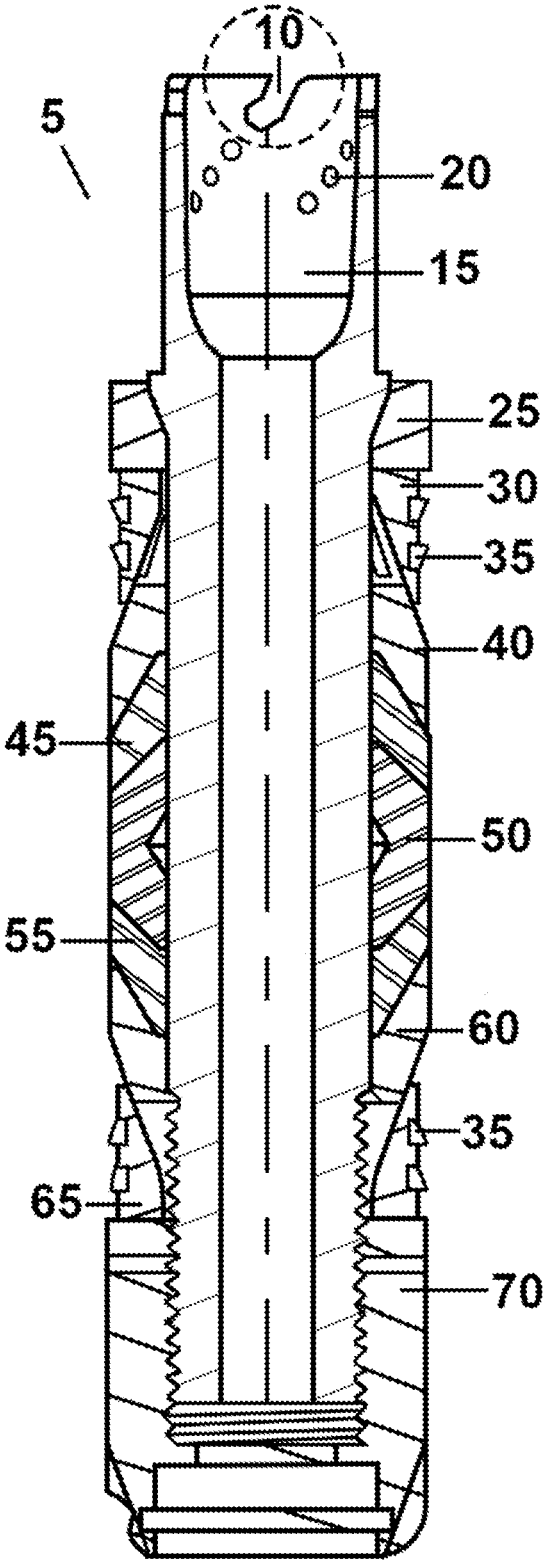
FIG. 4 is a cross-section side view of the plug.

FIG. 4 shows a cross-section sideview of the plug 5 completely assembled. As already discussed, the mandrel 15 runs through the whole plug 5 and is attached to the nose cone 70 by a threaded connection. The top of the mandrel 15 features several J-latches 10 and sheer screw holes 20 to secure the plug 5 to the setting adapter. After installation of the plug 5, the setting adapter and plug 5 can be released from each other by using sheer screws installed into adapter and shear screw holes 20 on mandrel 15 and applying pressure to shear the screws.

Figure 4A:
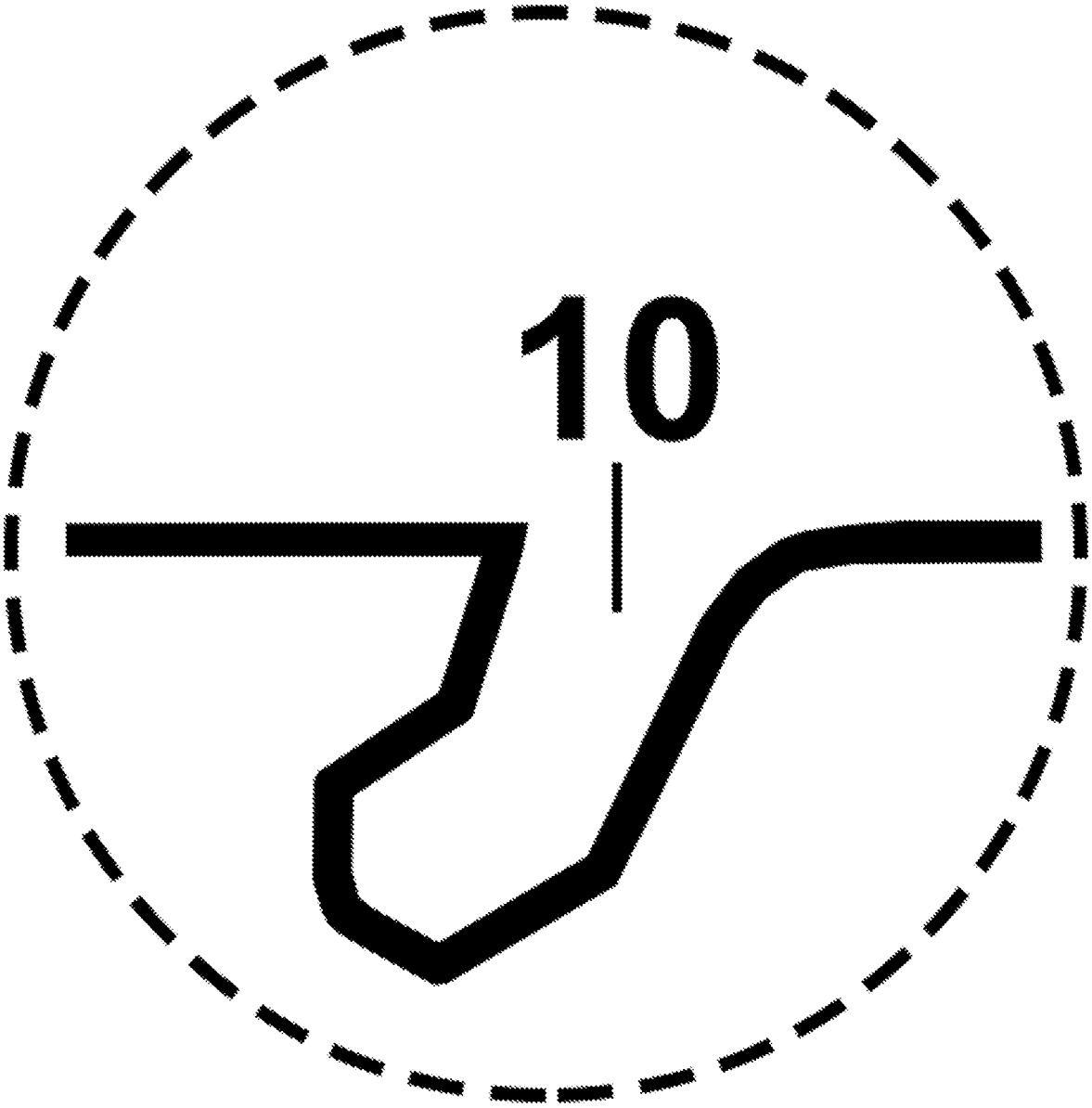
FIG. 4A is a close-up side view of the J-Latch 10 on the mandrel.

FIG. 4A is a close-up view showing a J-Latch 10 on the mandrel 15 as reflected on FIG. 4 marked as 4A. The J-latch 10 connects to the composite locking rod 15 in the nose cone 70 of the plug 5 above it when the plugs 5 are being drilled out and the nose cone 70 makes contact with the next plug 5 below it. The second portion of the mandrel 15 has a larger outside diameter which allows the setting adapter to sit more solidly in place so the tool does not easily slip out of its initial engagement.

Figure 5:
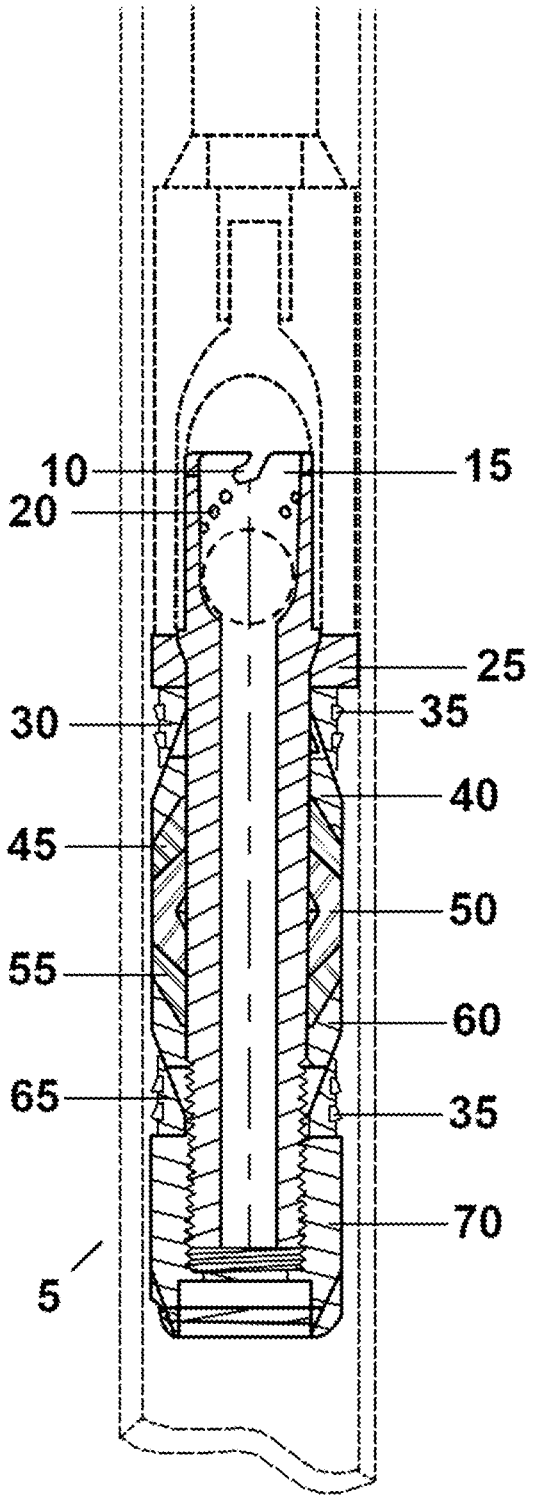
FIG. 5 is a cross-section side view of the plug in a wellbore using a ball-drop plug.

FIG. 5 shows a cross-section sideview of the plug 5 in a wellbore connected to a setting tool using a ball-in-place method or caged ball method that is known in the industry. The ball rests in the ball in place seating area 85 of the mandrel 15; when the chamber is pressurized, the ball lowers into the radius of the indicated cavity.

Figure 6:
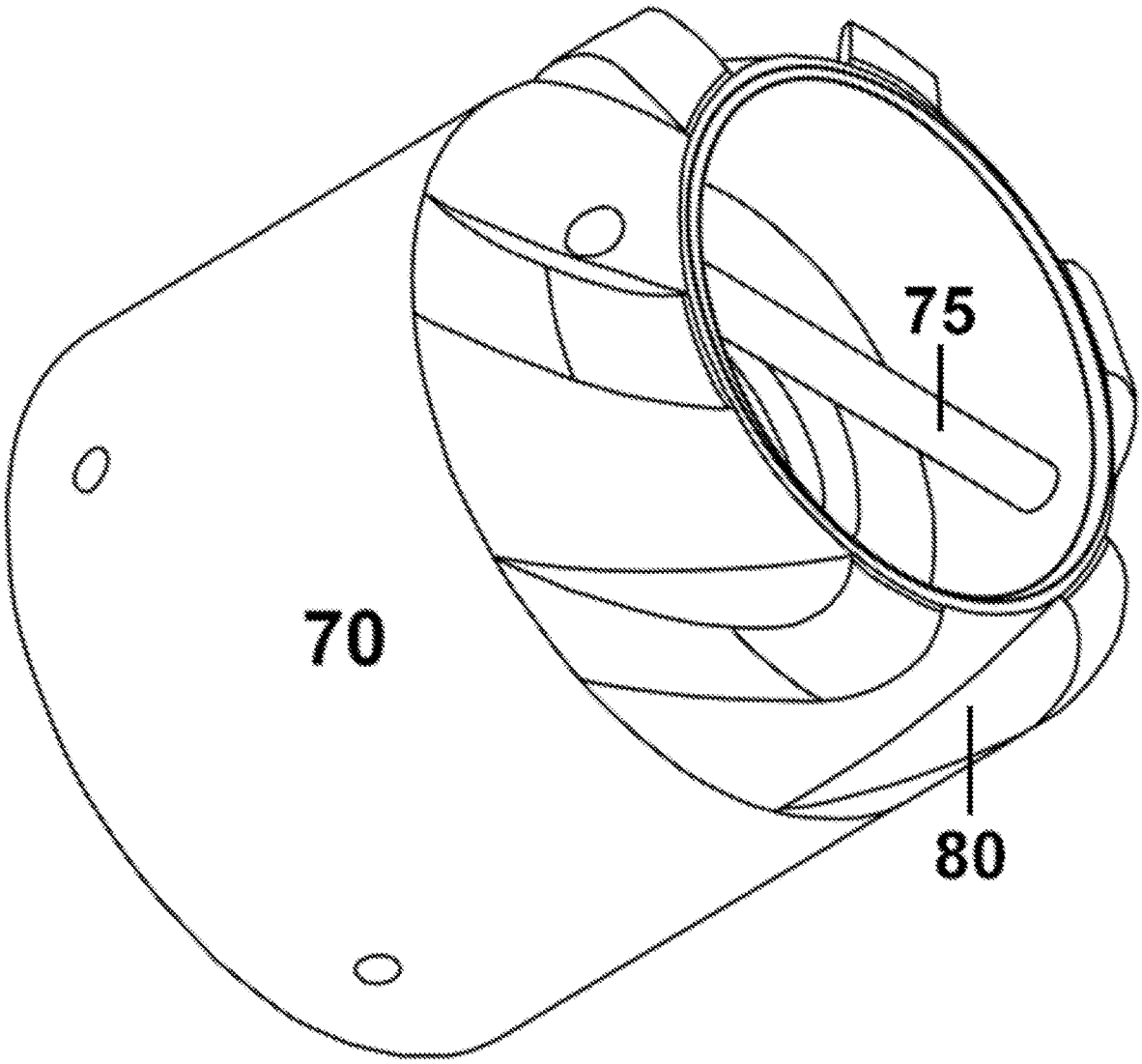
FIG. 6 is an orthogonal view of the invention's nose cone.
Figure 6A:
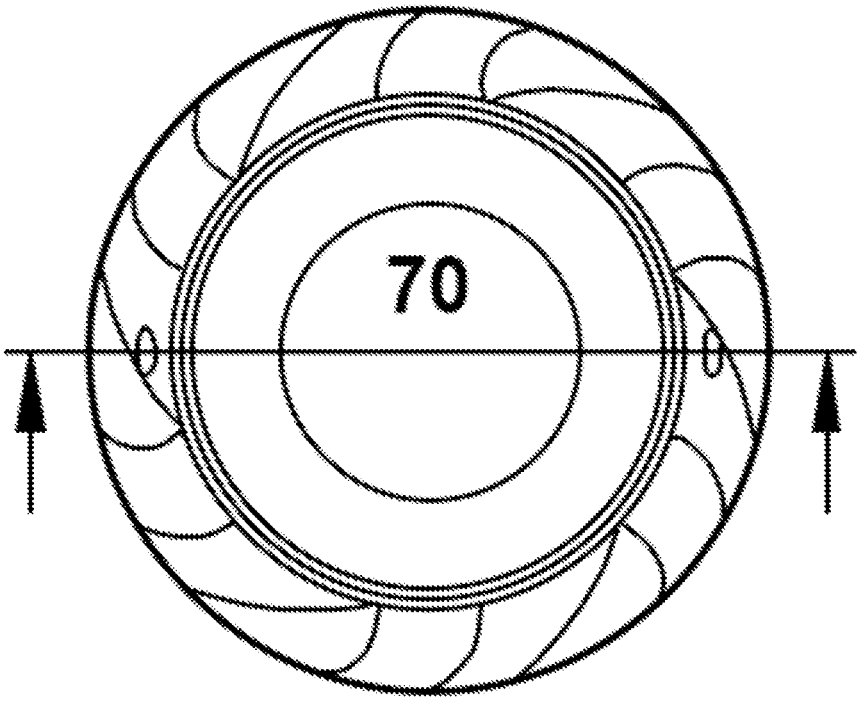
FIG. 6A is a top view of the nose cone piece of the plug indicating the section view shown in FIG. 6B.

FIG. 6 is an orthogonal view of the nose cone 70 piece of the plug 5. The nose cone 70 has an auger bit structure that disperses sand from the plug 5 as it travels downhole. The nose cone 70 features a bore for fluid run through the bit, as well as female threads to screw onto the mandrel 15. There is a composite locking rod 75 that runs across the diameter of the auger bit 80 into the locking rod holes and creates a positive locking mechanism when the rod makes contact with the J-latch 10 of the plug 5 below it FIG. 6A is a top view of the nose cone 70 piece of the plug 5 showing the section line. The nose cone 70 has an auger bit 80 design that surrounds the lower outside diameter of the nose cone 70, with two holes able to have a locking rod 75 run through it.

Figure 6B:
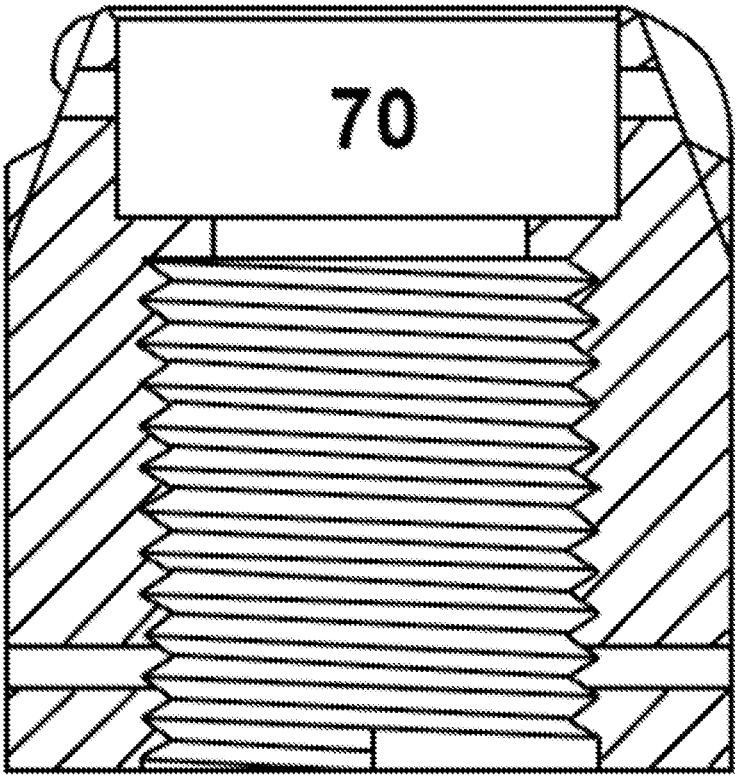
FIG. 6B is a cross-section view of the nose cone piece of the plug as indicated by the cross-section marks on FIG. 6A.

FIG. 6B is a cross-section view of the nose cone 70 piece of the plug. The nose cone 70 has female threads able to connect to the male threads 17 of the mandrel 15. The bottom of the nose cone 70 features an opening surrounded by an auger bit 80 blade design, with two holes capable of holding a locking rod 75. The opening of the nose cone 70 leads to a bore through the threads for liquid or sand to pass through the plug 5.

Figure 7:
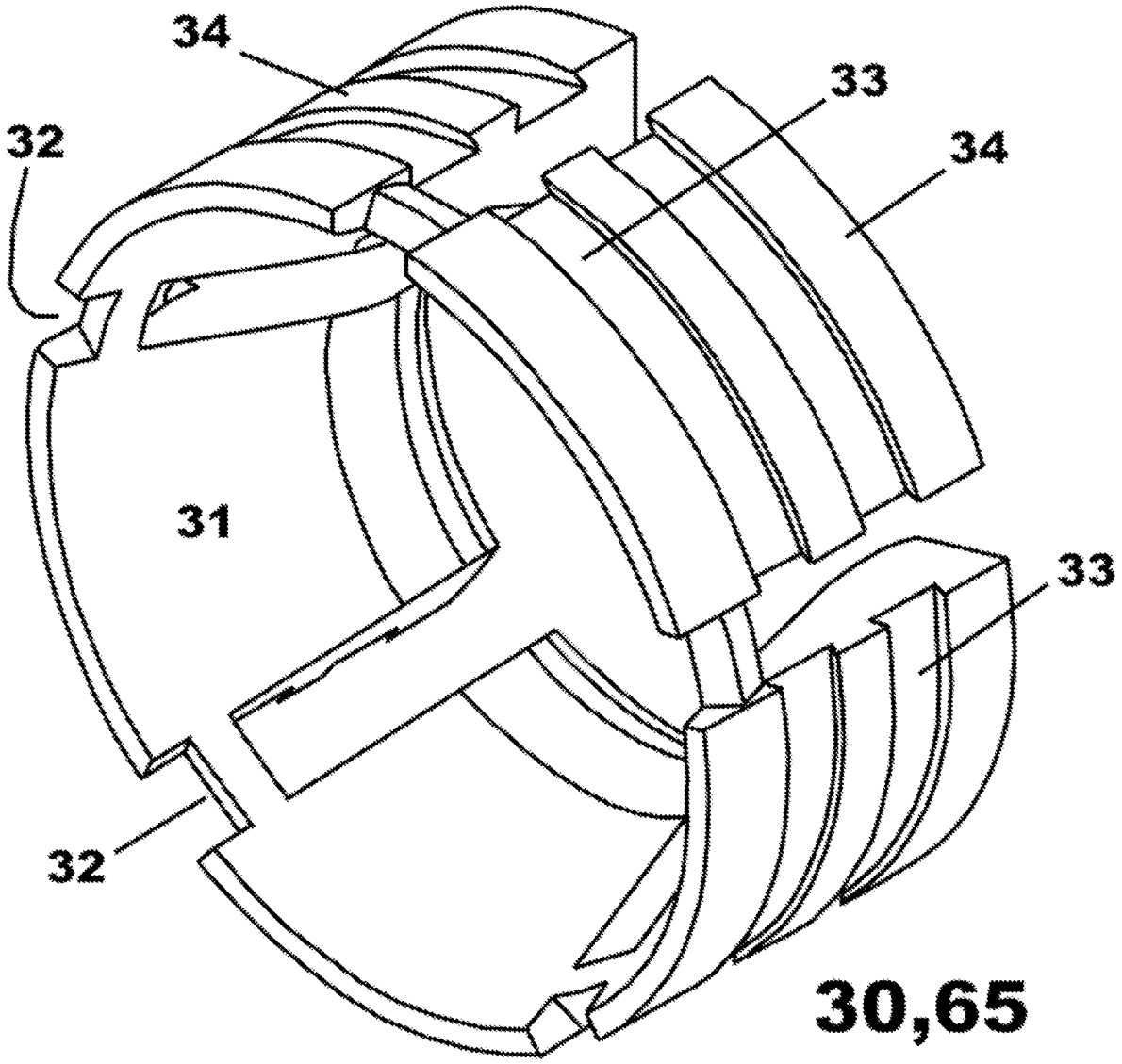
FIG. 7 is an orthogonal view of the invention's slip carrier elements 30, 65.

FIG. 7 is an orthogonal view of the lower slip carrier 65 and upper slip carrier 30 which are identical and mount on the plug 5. The anchors 35 are connected to the slip carriers 30, 65 by tongue-and-grove method. The slip carriers 30, 65 feature five connected slip carrier segments 34 and two rows for tongue-and-groove anchor connection 33 for the anchors 35. The tapered interior surface 31 of the slip carriers 30, 65 face inward towards the plug 5 is angled such that the break-away segment connectors 32 between the five slip carrier segments 34 of the slip carriers 30, 65 are at the smaller cross-section end of the slip carrier; these break-away segment connectors 32 are deliberately designed to prevent individual segments from extending outward during run in and break when the plug 5 becomes compressed, allowing the five slip carrier segments 34 to expand into the wellbore and anchor the plug 5 in place so it cannot slip from its set position. (The phrase run in refers to the placement of the plug into down hole after drilling.)

When an axial load is placed on the plug 5, the upper slip 40 and lower slip 60 push under the interior inclined area of the upper carrier 35 and lower carrier 65, respectively, putting pressure on the carriers 30 to expand. This pressure breaks the break-away connectors 32 between the five carrier slip segments 34 and each segment is pushed outward from the mandrel 15 so the anchors 35 held in the carriers extend from the plug 5 and into the wall of the wellbore casing, preventing the plug 5 from moving in the wellbore.

Figure 7A:
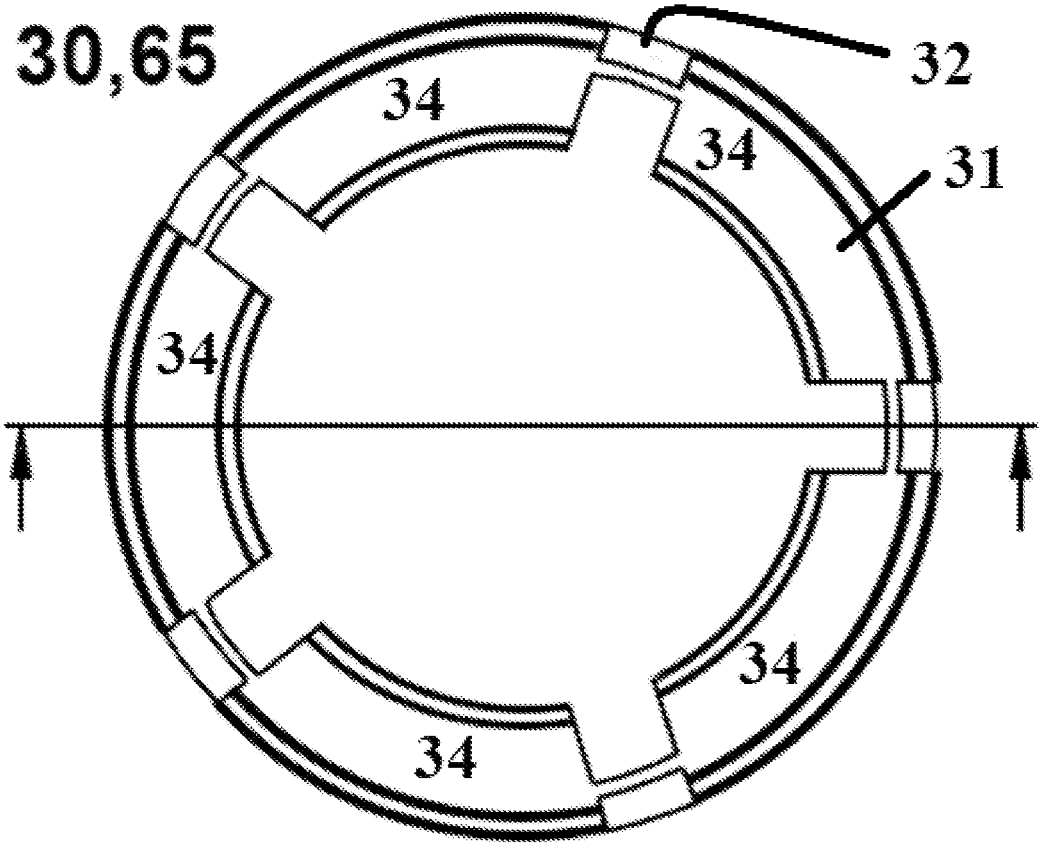
FIG. 7A is a top view of the carrier element showing section lines defining the view of FIG. 7B.
Figure 7B:
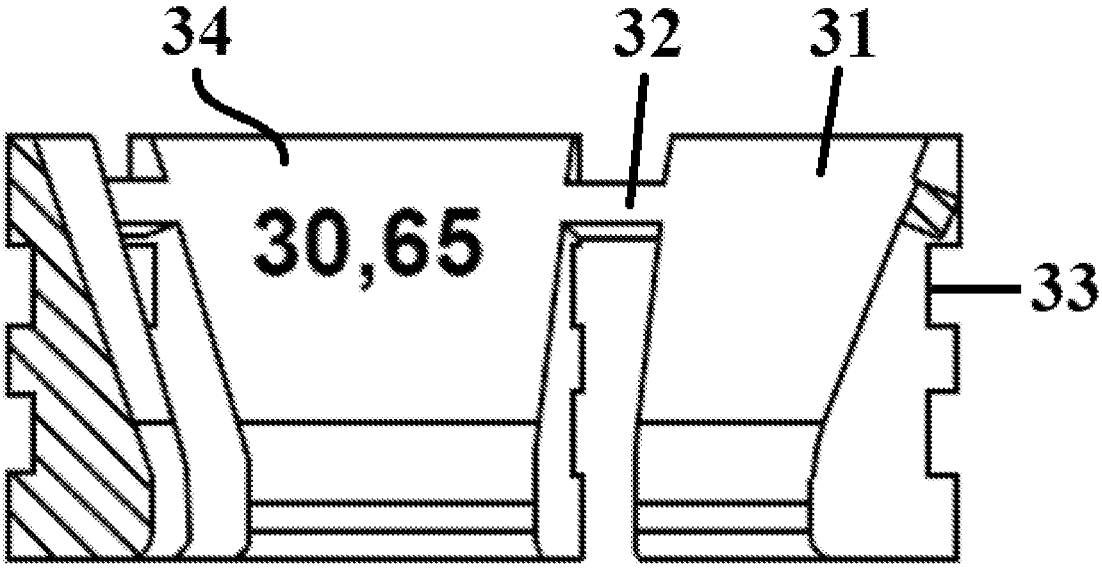
FIG. 7B is a cross-section view of the carrier piece of the plug based on the section lines shown in FIG. 7A.

FIG. 7A is a top view of the identical lower carrier 65 and upper slip carrier 30 showing the section lines used to define FIG. 7B. The carriers feature five slip carrier segments 34 and break-away connectors 32 which allow the carrier segments to expand when the plug is axially compressed.

FIG. 7B shows the view defined by the cross-section indication lines in FIG. 7A of the slip carriers 30, 65. The cross-section shows the side view of slip carrier segments 34 of the slip carriers 30, 65 being connected by the break-away segment connectors 32 on the thinner cross section of the tapered interior surface 31 of the carriers slip 30, 65 made of the same material and able to break when an expanding force is expressed on the segments when the plug 5 is axially compressed when the plug is set. The exterior surface of the slip carriers 30, 65 comprises two tongue-and-groove anchor grooves 33 capable of containing anchors 35 using tongue-in-groove method. Tongue-In-Groove being defined as a groove with a larger area at bottom and a more narrow area at top, in which an anchor of the same design is slid into. This design prevents the anchor from dislodging from the slip carrier.

As shown in FIGS. 7, 7A, and 7B, the slip carriers 30, 65 are wider at their base than their top (defining the "top" to be the end nearest the break-away segment connectors 32. The carrier has a relatively consistent exterior diameter across the slip carrier segments 34, not counting the tongue-and-groove spaces in which the anchors 35 are fitted, but the interior surface includes a tapered interior surface 31 that matches the exterior surface slope of the upper slip backup 40 and lower slip backup 60.

Figure 8:
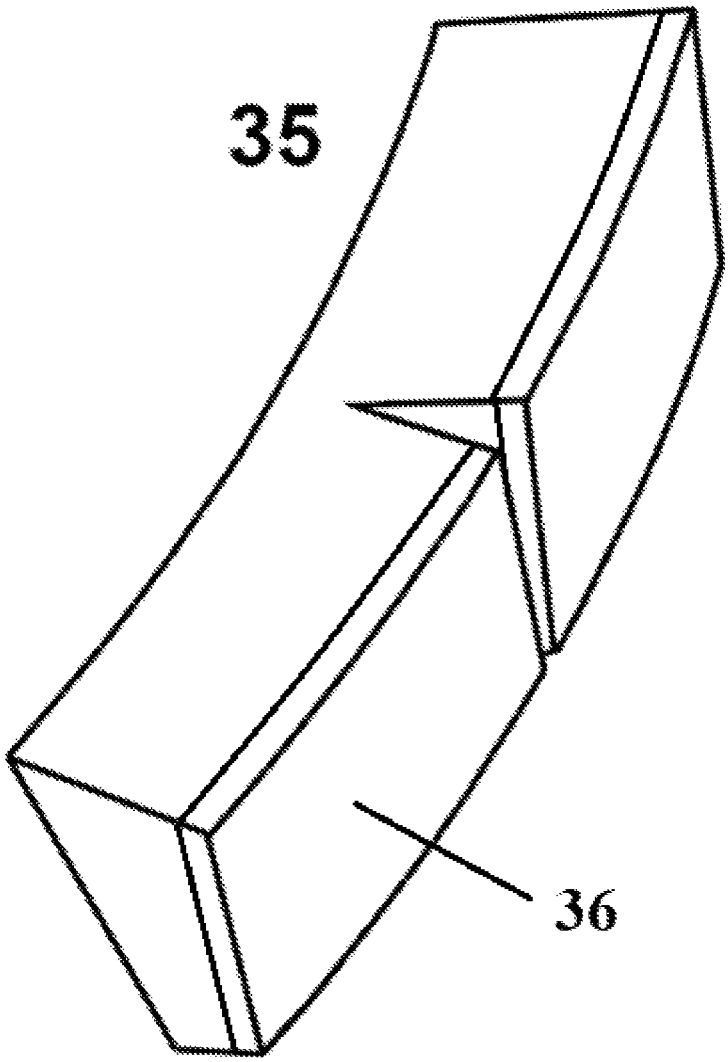
FIG. 8 is an orthogonal view of an anchor element.

FIG. 8 is an orthogonal view of an anchor 35 piece of the plug 5. The anchors 35 are currently manufactured of soft steel. The current design includes a heat-treatment section of the anchor 36 for the 2 mm from the outside edge of their exterior surface, allowing the anchors 35 to be have an effective bite on the wellbore casing while the anchor 35 is maintaining position, but allows the plug 5 to be more easily drilled through than the plug 5 would be if the anchors 35 were of a harder steel throughout. The anchors 35 feature a partial slit in the middle which allows them to break into smaller pieces. The anchors 35 fit onto the two tongue-and-groove anchor connection 33 rows of the five slip carrier segments 34 using a tongue-and-grove construction. These anchors 35 secure the plug 5 in the wellbore casing when the plug 5 is compressed and forces the inclined slip backup 40, 60 and the anchors 35, to expand and breaking the connections between the five slip anchor carrier segments 34.

Figure 9:
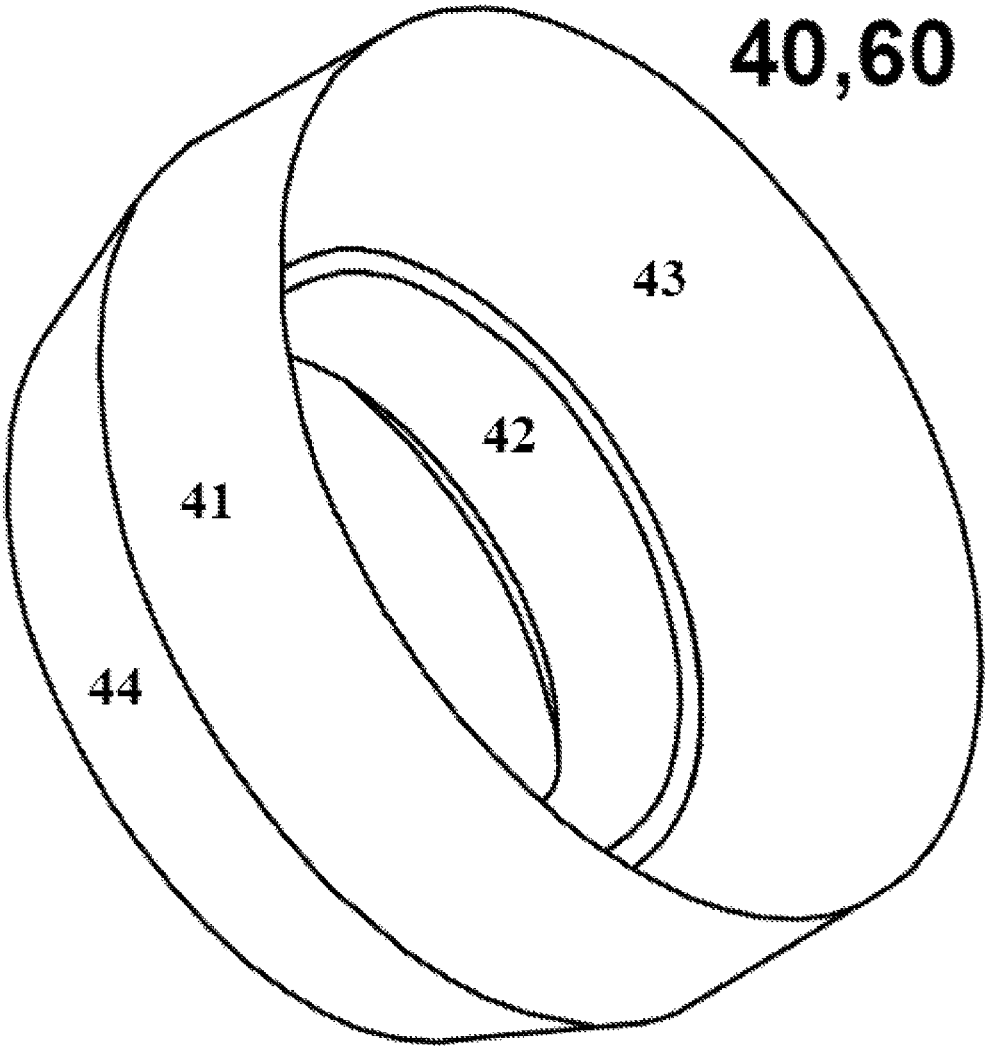
FIG. 9 is an orthogonal view of the slip backup elements 40, 60.

FIG. 9 is an orthogonal view of the slip backups 40, 60 of the plug 5. The slip backups 40, 60 are circular and comprise a bore with a slip ring flat exterior surface 41 and a beveled area having a smaller exterior diameter inclined tapered surface 44 and facing a slip carrier 30, 65 so that when the plug 5 is compressed, the slip carrier segments 34 will break and compress against the slip ring exterior inclined tapered surface 44 of the slip backups 40, 60. The slip backups 40, 60 are adjacent to the slip carriers 30, 65 positioned inward towards the center of the plug 5. The interior of the slip backups 40, 60 have an inward angled slip backup interior inclined surface 43 leading to a slip backup flat interior surface 42 which is in contact with the mandrel 15 and a second angled surface that rises from the edge of the slip backup flat interior surface 42 to a rim, the space created by the slip backup interior inclined surface 43 allows the small elastomer seal 45 or lower small elastomer seal 55 to fit inside the slip backups 40, 60.

Figure 9A:
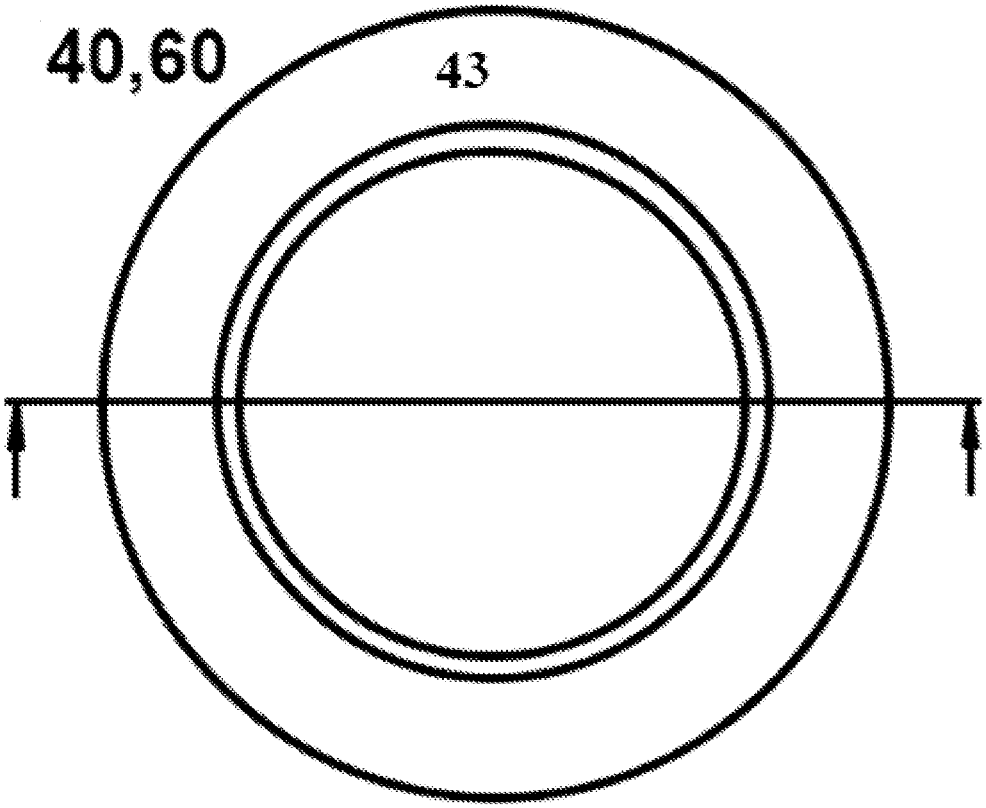
FIG. 9A is a top view of the slip backup elements showing section lines to develop FIG. 9B.
Figure 9B:
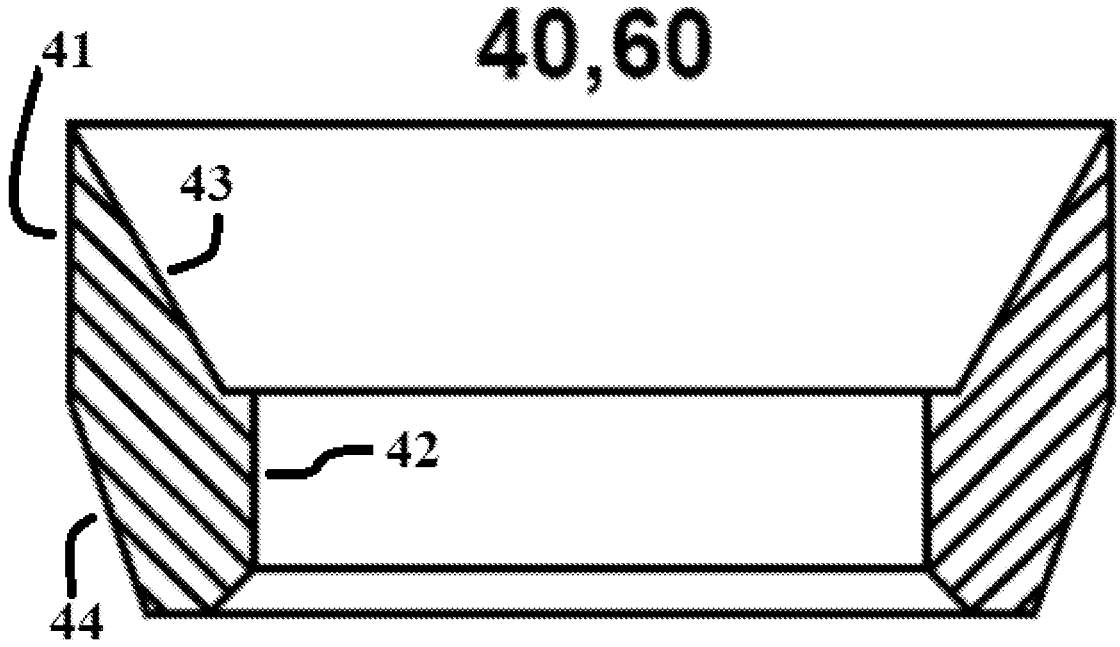
FIG. 9B is a cross-section view of the slip backup element as indicated in FIG. 9A.

FIG. 9A is a top view of the slip backup 40, 60 showing the section line used to define FIG. 9B. The slip backup 40, 60 piece has an outside diameter section and inside ridge that allows the small elastomer seal 45, 55 to fit inside the slip backups 40, 60, as shown in FIGS. 3 and 4.

FIG. 9B is a cross-section view of the slip backup 40, 60 piece of the plug 5. The top-half of the exterior surface of the slip backup 40, 60 has a flat exterior surface 41 then near the center declines inward as slip backup exterior tapered surface 44. The slip backup interior inclined surface 43 of the top half of the slip backup 40, 60 inclines toward the middle to the slip backup flat interior surface 42. The inside surface of the bottom-half of the slip backup 40, 60 inclines inward briefly then is flat when it meets the top-half.

Figure 10:
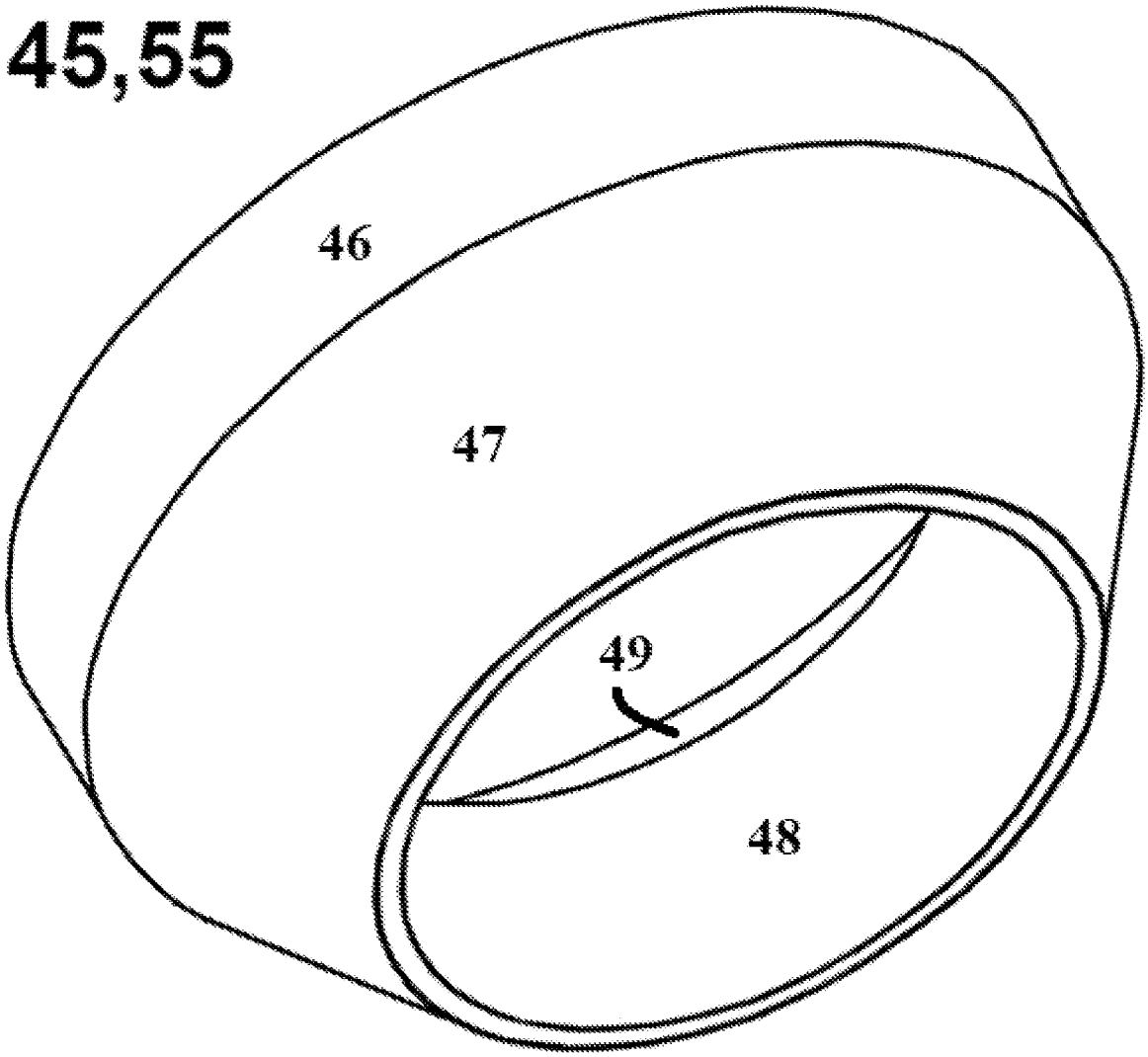
FIG. 10 is an orthogonal view of the small elastomer seal elements 45, 55.

FIG. 10 is an orthogonal view of the small elastomer upper seal 45 and small elastomer lower seal 55. The small elastomer seal 45, 55 is "small" as it is relatively less in volume compared to the large elastomer seal 50. The small elastomer seals are circular and include a bore with a small elastomer seal flat exterior surface 46 section and an inward angled small elastomer seal exterior inclined tapered surface 47 section facing towards the slip backups 40, 60. The small elastomer seals 45, 55 are placed adjacent to the slip backups 40, 60 and the large elastomer seal 50 is secured between the slip backups 40, 60 positioned inward towards the center of the plug 5. The inside diameter features a small elastomer seal interior inclined tapered surface 49 angled to a small elastomer seal flat interior surface 48 rim allowing the small elastomer seal 45 or the lower small elastomer seal 55 to fit inside the slip backups 40, 60 adjacent to the large elastomer seal 50.

Figure 10A:
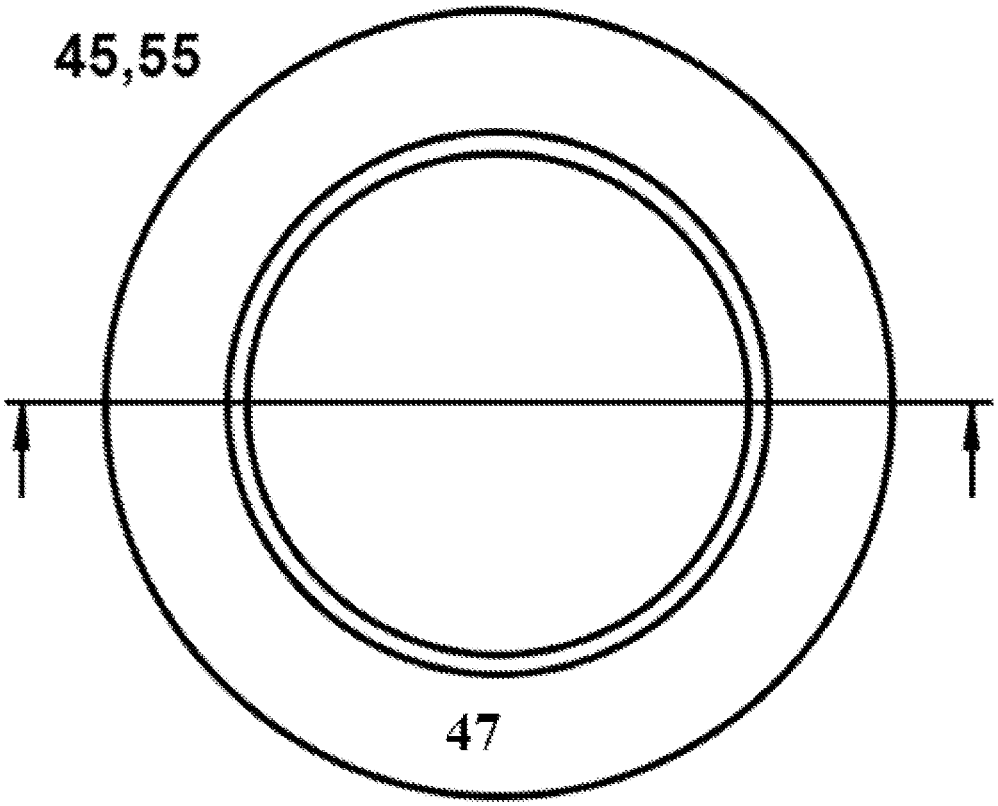
FIG. 10A is a top view of the small elastomer seal elements with section lines defining FIG. 10B.

FIG. 10A is a top view of the small elastomer seal 45, 55, which are mounted on the plug 5. The section lines shown here define FIG. 10B. The small elastomer seal 45, 55 includes an inside rim for the large elastomer seal 50 to fit inside the small elastomer seal 45, 55, as shown in FIG. 1 to 4.

Figure 10B:
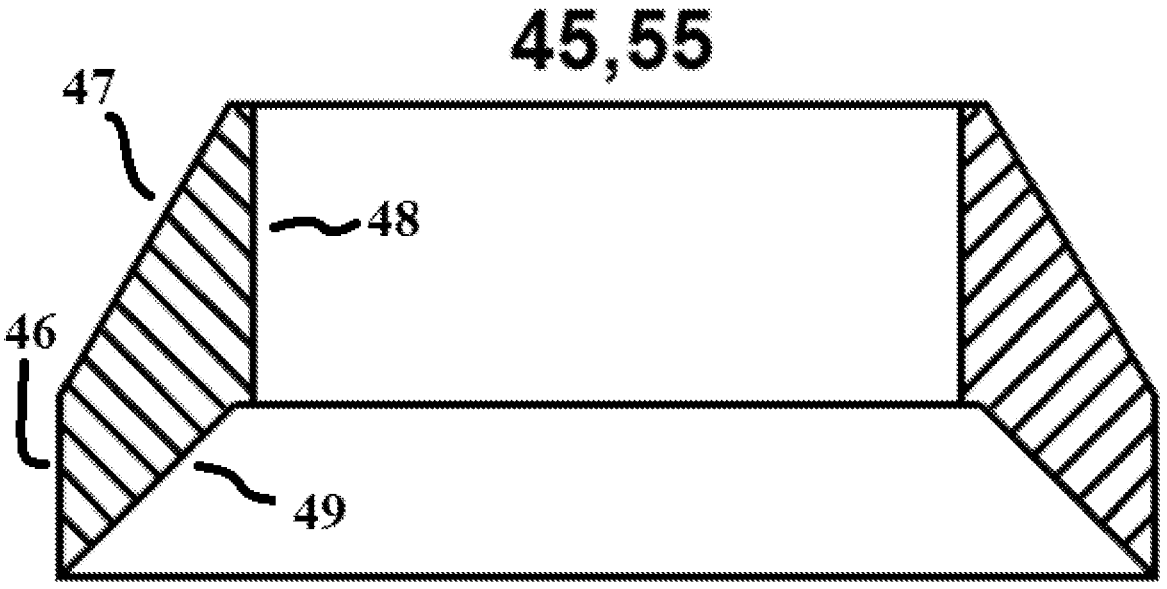
FIG. 10B is a cross-section view of the small elastomer is seal element as defined in FIG. 10A.

FIG. 10B is a cross-section view of the small elastomer seal 45, 55. The outside surface of the small elastomer seal 45, 55 begins with a flat area then continues to a beveled area having a tapered smaller outside diameter 47. The top opening widening with a small elastomer seal exterior beveled surface 47 to a flat exterior surface 46. The small elastomer seal flat interior surface 48 is flat then expands outward to a small elastomer seal interior inclined tapered surface 49. The inside surface includes is tapered to fit the large elastomer seal 50.

Figure 11:
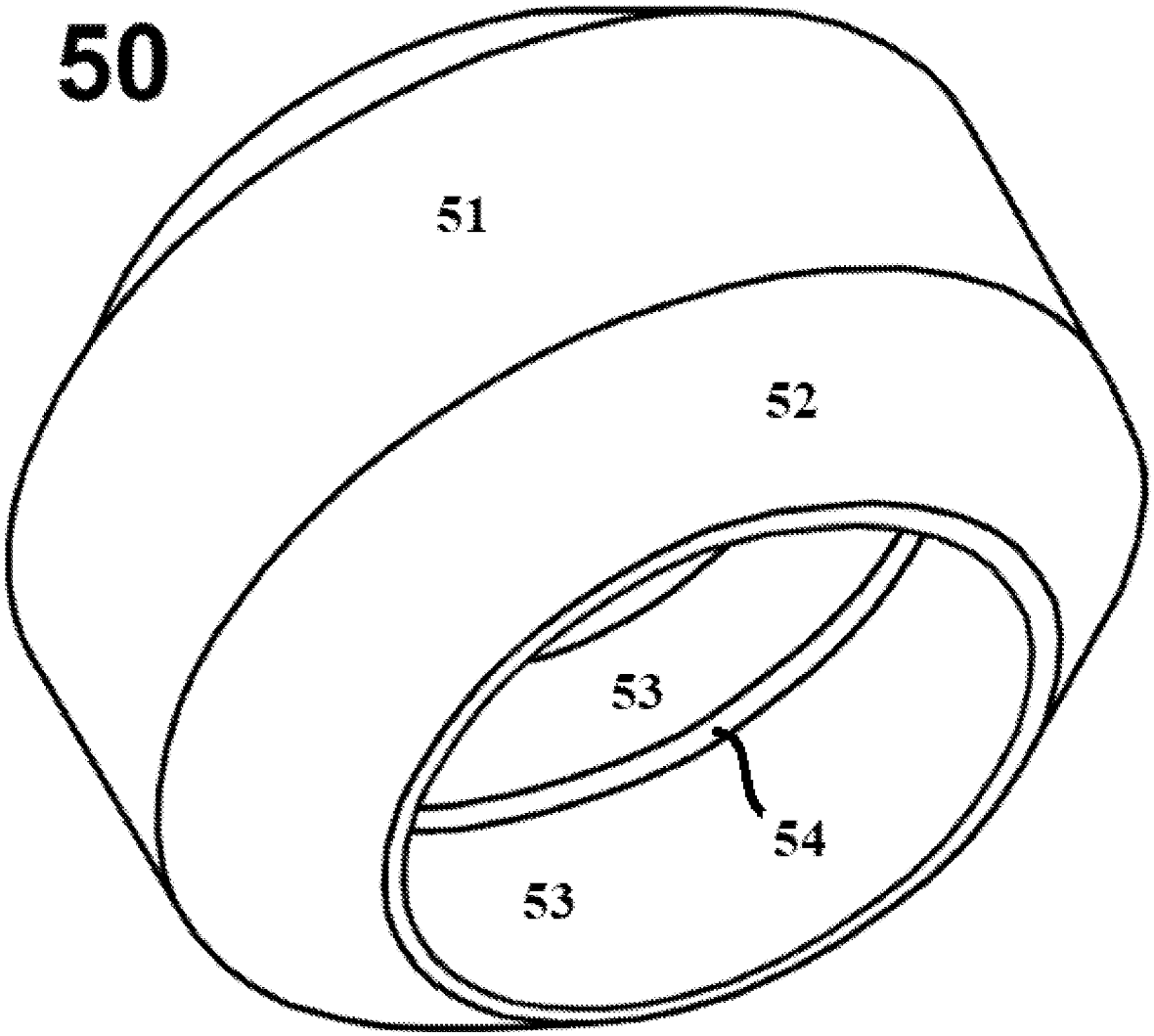
FIG. 11 is an orthogonal view of the large elastomer seal element 50.

FIG. 11 is an orthogonal view of the large elastomer seal 50, also shown on FIGS. 1-5. The large elastomer seal 50 is in the current embodiment located near the middle of the plug 5 and surrounds the mandrel 15. The large elastomer seal 50 is "large" as it is relatively greater in volume compared to the small elastomer seal 45, 55. The large elastomer seal 50 comprises a central large elastomer seal exterior flat surface 51, and declining angled large elastomer seal exterior tapered surfaces 52 extending from either side of the large elastomer seal exterior flat surface 51. The large elastomer seal exterior tapered surfaces 52 will fit inside the small elastomer seals 45, 55 on each side of the large elastomer seal 50. The inside diameter of the large elastomer seal interior flat surface 53 has a V-Groove 54 in the middle of the flat surface used to allow center expansion of the large elastomer seal 50 around the mandrel 15.

The large elastomer seal has a defined durometer which assists this central element of the plug to expand when an axial load is placed on the plug when being set. The more axial pressure that is on the plug, the greater pressure on both tapered surfaces 52, action causes the seal to bulge outward, assisting to keep the plug in place by creating additional friction against the wellbore, but also seals off the zone below the plug 5 from the zone above the plug 5, sealing the zones apart from each other.

Figure 11A:
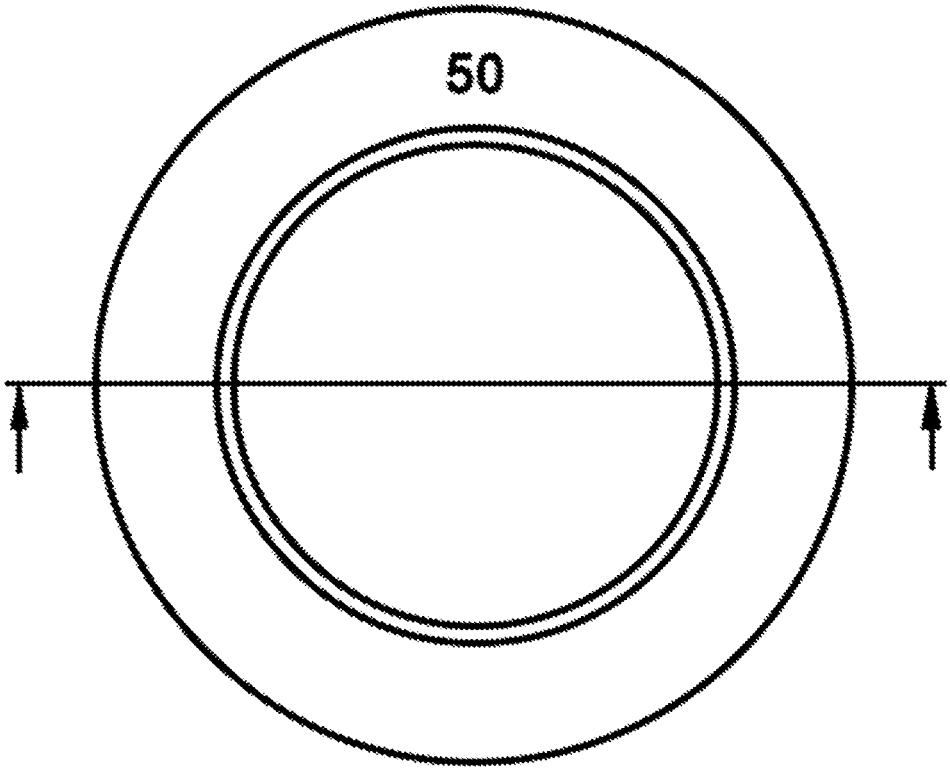
FIG. 11A is an orthogonal view of the large elastomer seal element with section lines to define the view of FIG. 11B.

FIG. 11A is a top view of the large elastomer seal 50 piece of the plug 5 showing the section line. The large elastomer seal 50 includes an inside rim to fit between the small elastomer seal 45, 55 pieces.

Figure 11B:
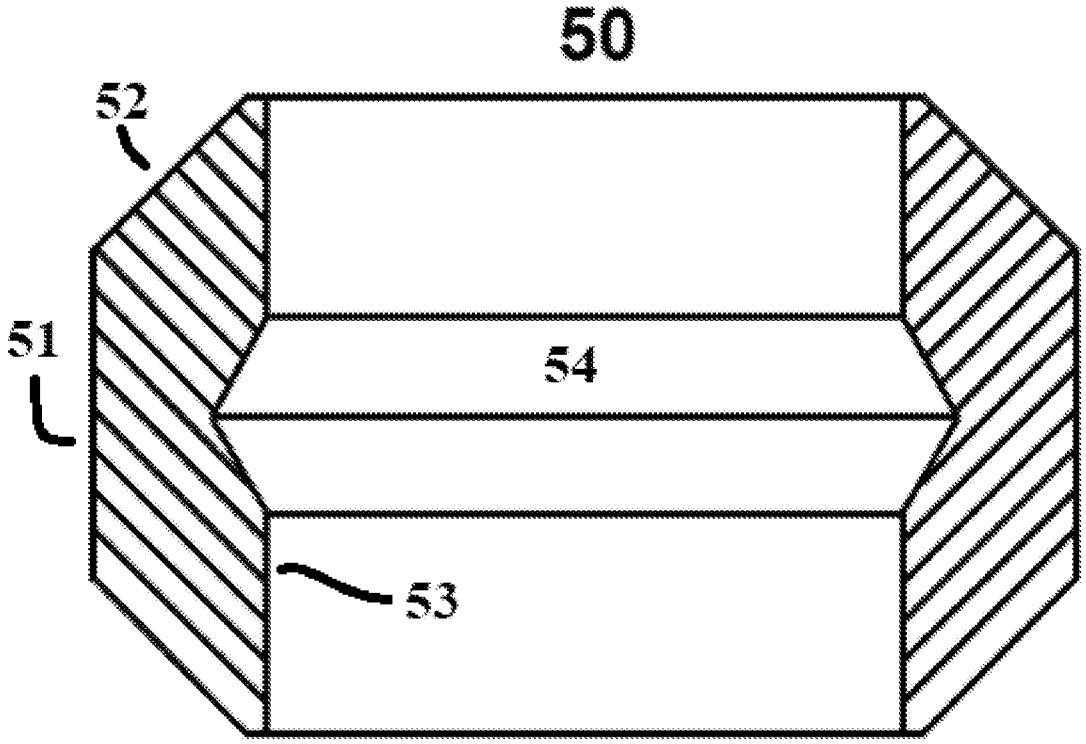
FIG. 11B is a cross-section view of the large elastomer element as defined by the section lines in FIG. 11A.

FIG. 11B is a cross-section view of the large elastomer seal 50 piece of the plug 5. The large elastomer seal 50 piece has a large elastomer seal exterior flat surface 51 and tapered surfaces 52, on each side of the flat surfaces 51. The large elastomer seal interior flat surface 53 of the large elastomer seal 50 is flat with a large elastomer seal interior V-groove 54 in the middle. The flat interior is designed to seal the large elastomer seal 50 against the mandrel 15.

Figure 12:
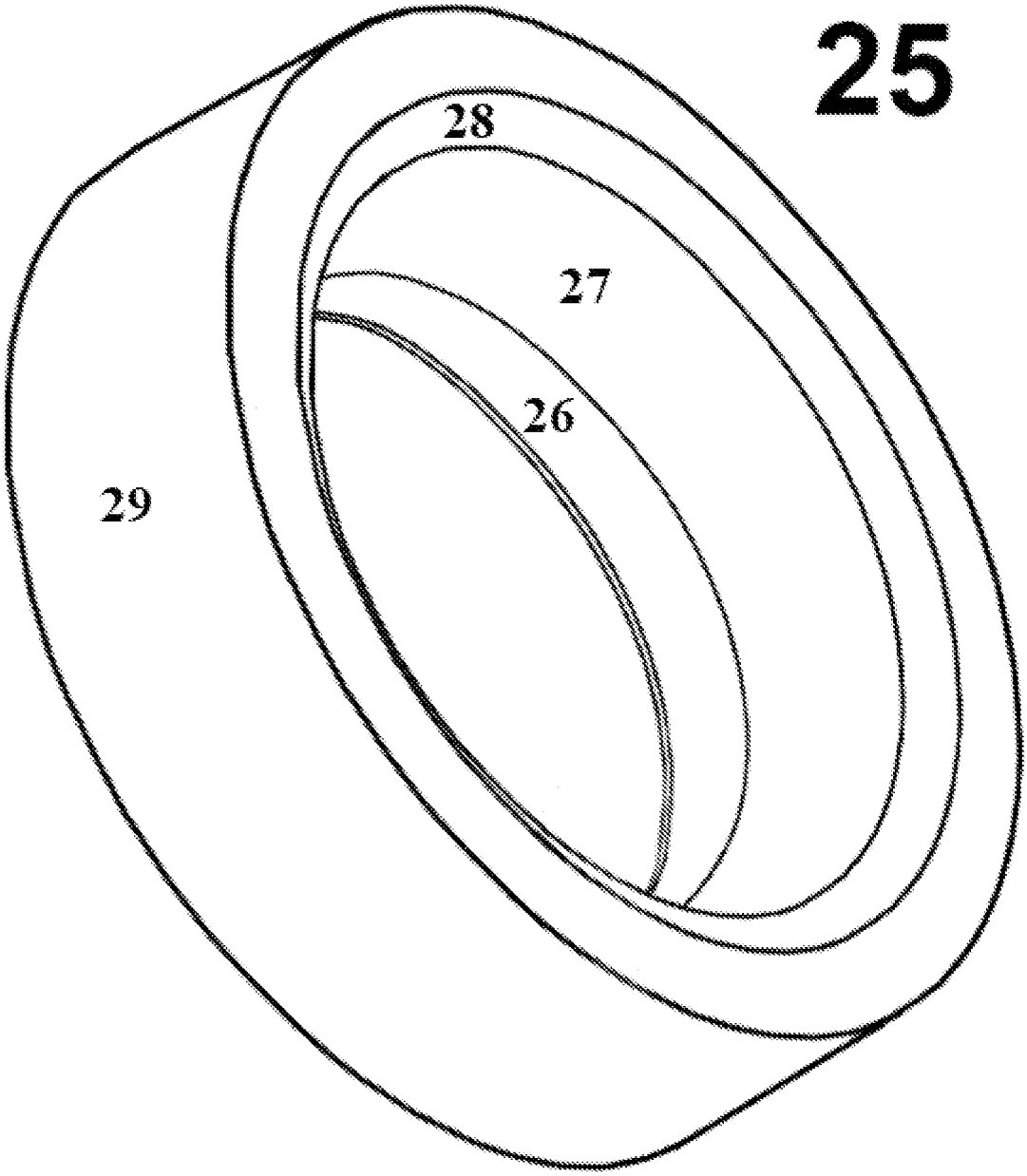
FIG. 12 is an orthogonal view of the load ring 25 element of the invention.

FIG. 12 is an orthogonal view of the load ring 25 piece of the plug 5. It is circular including a bore with an exterior load ring flat surface 29 that angles inward to a smaller interior load ring flat lip 28 section. The interior load ring lip 28 connects to an interior load ring tapered surface 27 that connects to an interior load ring flat surface 26. The load ring 25 is placed on the outside of the mandrel tapered surface 16.

Figure 12A:
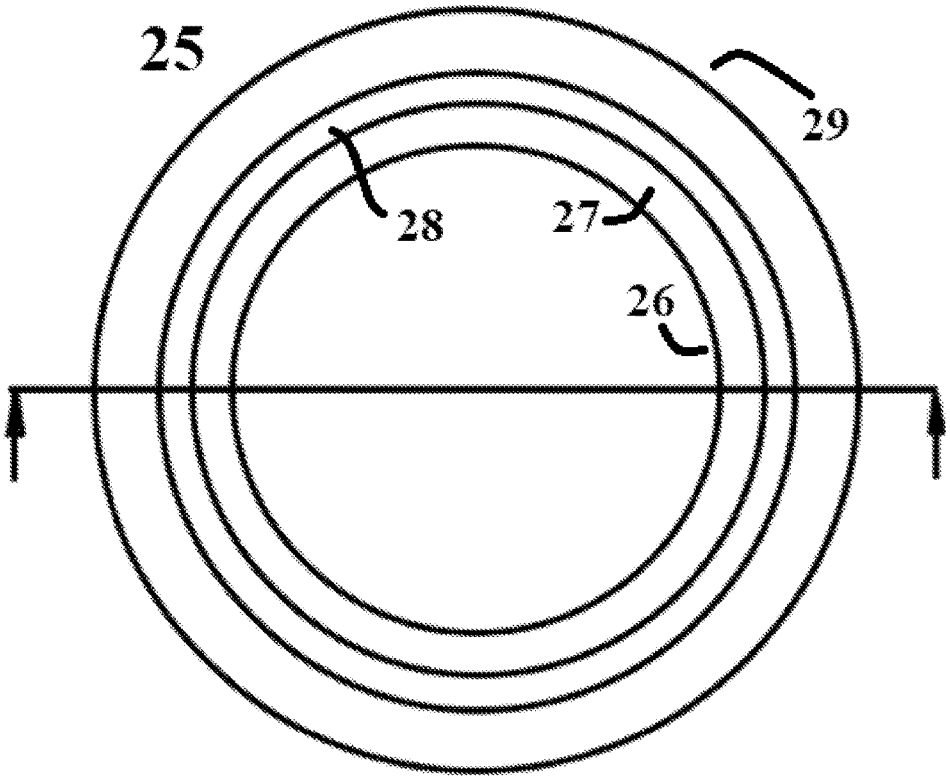
FIG. 12A is a top view of the load ring element showing section lines used to define FIG. 12B.

FIG. 12A is a top view of the load ring 25 piece of the plug 5. The load ring 25 has a flat outside circular surface and a tapered inside surface that will make contact against the mandrels tapered surface 16 and down to a flat inside surface of the load ring 25.

Figure 12B:
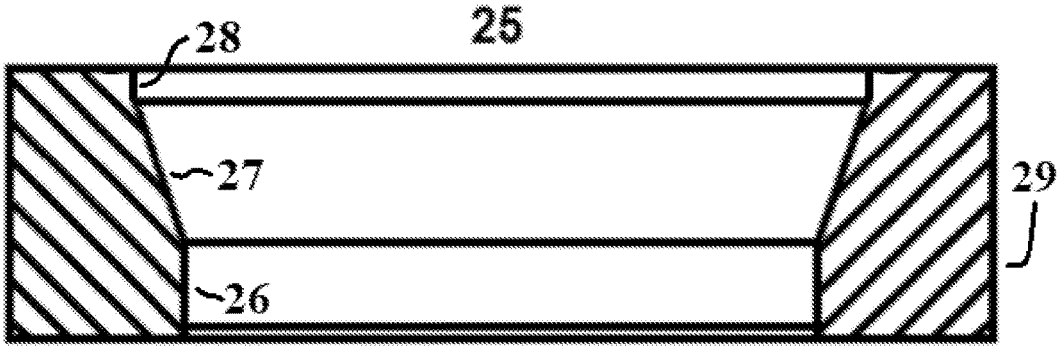
FIG. 12B is a cross-section view of the load ring element as defined by FIG. 12A.

FIG. 12B is a cross-section view of the load ring 25 piece of the plug 5. The load ring 25 includes an exterior flat surface 29 with an interior load ring lip 28 and an interior load ring tapered surface 27 extending to an interior load ring flat surface 26.

Figure 13:
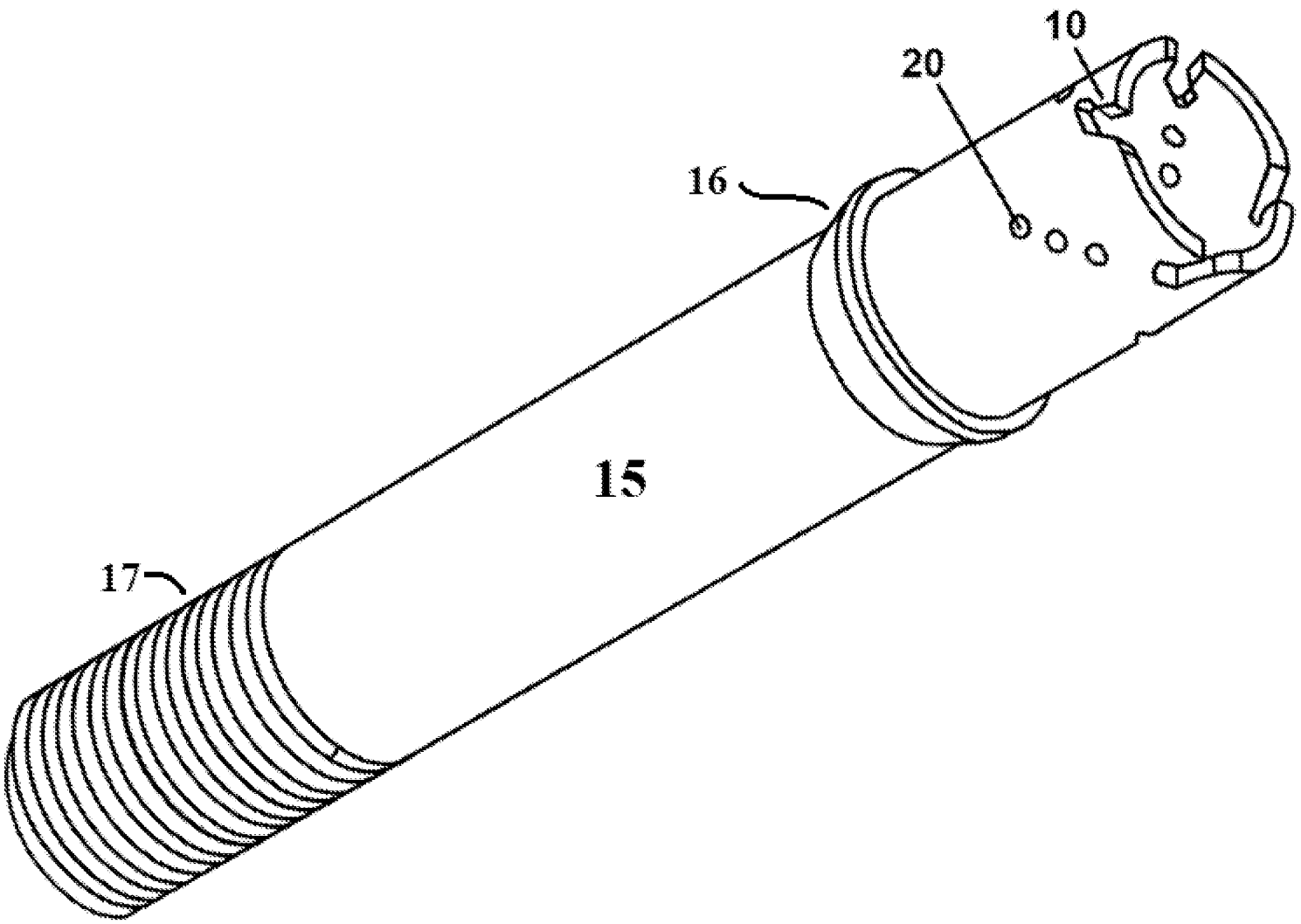
FIG. 13 is an orthogonal view of the mandrel 15.

FIG. 13 is an orthogonal view of the mandrel 15 piece of the plug 5. The mandrel 15 is cylindrical in form and is the center section of the plug 5, with all the pieces placed around the mandrel 15. The mandrel 15 features a bore so liquid can pass through. The mandrel 15 features J-latches 10 which create a positive locking mechanism when contacted with the locking rod 75 of the nose cone 70. The mandrel 15 also uses sheer screw holes 20 to connect to the setting adapter with shear screws. The mandrel 15 has male threads 17 on the lower part of the mandrel and connects to the female threads of the nose cone 70. The load ring 25 makes contact with the tapered outside diameter of the upper part of the mandrel, and is placed onto the lower half of the mandrel 15, and pushed up the mandrel 15, until the inside diameter taper of the load ring 25 makes contact with the outside taper of the upper mandrel 15 section. This allows the plug 5 parts to move along the axis of the plug 5, between the nose cone 70, and load ring 25, while being compressed during setting action. The top of the mandrel 15 includes a hollow tapered space in the top of the mandrel 15 for a ball-in-place or ball-drop frac ball to seat against the composite seating area.

In this embodiment, the small elastomer seals 45, 55 and large elastomer seal 50 are constructed with specific desired durometers, such that each of the three seals expand under axial pressure in a way that allows the expansion to assist in holding the plug 5 in a set position in the wellbore and sealing against the mandrel 15 in the inside diameter and the casing on the outside diameter. Depending on the specific desired design, a user can ensure that the three elastomer seals expand during the setting process in a desired order by using specific durometers to ensure specific behavior.

In the current embodiment, the large elastomer seal has a softer durometer allowing it to expand first by having more elasticity than the small seals; as the pressure increases, the small seals also expand. Alternatively, a user may wish for all three to expand simultaneously by using seals all made with the same durometer.

LEGEND

5 Plug
10 J-Latch
15 Mandrel, centerpiece all the way through plug
16 Mandrel tapered surface
17 Male Threads
20 Sheer Screw Holes
25 Load Ring
26 Interior Load Ring Flat Surface
27 Interior Load Ring Tapered Surface
28 Interior Load Ring Lip
29 Exterior Load Ring Flat Surface
30 Slip Carrier
31 Tapered Interior Surface
32 Break-Away Segment Connector
33 Tongue-and-Groove Anchor Connection
34 Slip Carrier Segment
35 Anchor
36 Heat-Treated Section of Anchor
40 Upper Slip Backup
41 Slip Ring Flat Exterior Surface
42 Slip Ring Flat Interior Surface
43 Slip Ring Interior Tapered Surface
44 Slip Ring Exterior Tapered Surface
45 Small Elastomer Seal
46 Small Elastomer Seal Flat Exterior Surface
47 Small Elastomer Seal Exterior Tapered Surface
48 Small Elastomer Seal Flat Interior Surface
49 Small Elastomer Seal Interior Tapered Surface
50 Large Elastomer Seal
51 Large Elastomer Seal Exterior Flat Surface
52 Large Elastomer Seal Exterior Tapered Surface
53 Large Elastomer Seal Interior Flat Surface
54 Large Elastomer Seal Interior V-Groove
55 Lower Small Elastomer Seal
60 Lower Slip Backup
65 Lower Slip Carrier
70 Nose Cone
75 Locking Rod
80 Auger Bit
85 Ball In Place seating Area The inventor claims:

1. A plug for isolating a section of a wellbore, comprising:

a. a mandrel, further comprising
a lower end,
an upper end,
at least one pair of sheer screw holes near the upper end configured to attach to a setting tool,
a raised lip around the exterior of the mandrel near its upper end and below the sheer screw holes,
a tapered ball seat area in the upper section of the mandrel,
male threads on the lower end;
at least two J-latches in the top of mandrel;

b. a load ring compressed against the mandrel's raised lip;

c. a slip carrier mounted on the mandrel and adjacent to the load ring, said carrier further comprising a first flat interior surface matching the mandrel's exterior surface, and a second interior surface tapering from the first surface and radially tapering away from the mandrel, further comprising multiple segments attached together with break-away connectors, further comprising at least one row of tongue-and-grove connections;

d. anchors which fit into the tongue-and-grove connection of the carriers and extend from the carriers outward;

e. an upper slip backup, comprising a circular interior flat surface matching the exterior diameter of the mandrel, further comprising a second tapered exterior surface matching the angle of the slip carrier's tapered interior surface, and tapered inside surface, mating with the tapered outside surface of the small elastomer seal;

f. a small elastomer seal, comprising a first circular interior surface matching the exterior surface of the mandrel, and further comprising a second circular surface that tapers up from the first circular interior surface so it can mate with a tapered surface on a large elastomer seal, having also a first surface forming an exterior tapered surface matching the tapered interior surface of the upper slip backup;

g. a large elastomer seal, comprising a circular interior flat surface matching the diameter of the mandrel, and having a V-groove in the center, further comprising two tapered surfaces on the outside diameter, each surface matching the interior surface of a small elastomer seal, and a flat surface between the two tapered surfaces used to seal against the internal wall of casing wellbore;

h. a lower small elastomer seal mounted on the mandrel and identical to the upper small elastomer seal;

i. a lower slip backup mounted on the mandrel and identical to the upper slip backup;

j. a lower carrier including anchors mounted on the mandrel and identical to the upper carrier;

k. a nose cone affixed to the mandrel's lower end.

2. The plug as described in claim 1 in which the anchors comprise heat-treated metal, ceramics, epoxy, plastics, minerals and other materials.

3. The plug described in claim 1, in which the nose cone includes an auger bit blade design.

4. The plug described in claim 1, in which the mandrel includes J-latches.

5. The plug described in claim 1, in which the load ring is a separate part mounted on the mandrel.

6. The plug described in claim 1, in which the slip carriers are constructed of a non-metal material.

7. The plug described in claim 1 in which the nose cone has a locking rod.

8. The plug described in claim 1 in which the large elastomer seal is configured to expand outward when the plug is compressed along its axis when the plug is under a load.

9. The plug described in claim 1 in which the small elastomer seals are configured to expand outward when the plug is compressed along its axis when the plug is under a load.

10. The plug described in claim 1 in which the durometers of the small elastomer seals is higher than the large elastomer seal, so that the two small elastomer seals expand less than the large elastomer seal when the plug is under an axial load.

11. The plug described in claim 1 in which the durometers of the small elastomer seals is higher than the large elastomer seal, so that the two small elastomer seals expand after the large elastomer seal when the plug is under an axial load.

12. The plug described in claim 1 in which the durometers of the small elastomer seals is the same as the large elastomer seal, so that the two small elastomer seals and the large elastomer seal expand at a similar rate when the plug is under an axial load.

* * * * *